US005816049A

United States Patent [19]

Joshi

[11] Patent Number: 5,816,049

[45] Date of Patent: Oct. 6, 1998

[54] DUAL FUEL MIXER FOR GAS TURBINE COMBUSTOR

[75] Inventor: Narendra D. Joshi, Cincinnati, Ohio

[73] Assignee: General Electric Company, Cincinnati, Ohio

[21] Appl. No.: 778,133

[22] Filed: Jan. 2, 1997

[51] Int. Cl.[6] ..... F23R 3/14; F23R 3/36

[52] U.S. Cl. ..... 60/737; 60/39.463; 60/748

[58] Field of Search ..... 60/39.463, 737, 60/746, 747, 748

[56] References Cited

U.S. PATENT DOCUMENTS

| | | | |
|---|---|---|---|
| 3,946,552 | 3/1976 | Weinstein et al. | 60/748 |
| 4,726,192 | 2/1988 | Willis et al. | 60/737 |
| 5,062,792 | 11/1991 | Maghon | 60/748 |
| 5,165,241 | 11/1992 | Joshi et al. | 60/737 |
| 5,251,447 | 10/1993 | Joshi et al. | 60/737 |
| 5,351,477 | 10/1994 | Joshi et al. | 60/39.463 |
| 5,408,825 | 4/1995 | Foss et al. | 60/737 |
| 5,435,126 | 7/1995 | Beaudoin | 60/39.463 |

*Primary Examiner*—Louis J. Casaregola
*Attorney, Agent, or Firm*—Andrew C. Hess; Patrick R. Scanlon

[57] ABSTRACT

An apparatus for premixing fuel and air prior to combustion in a gas turbine engine is disclosed as including a linear mixing duct having a circular cross-section defined by a wall. A gas fuel manifold is positioned adjacent the upstream end of the mixing duct and is in flow communication with a gas fuel supply and control means. An outer annular swirler is oriented radially to the mixing duct and positioned adjacent the upstream end of the mixing duct to impart swirl to an air stream entering the outer annular swirler. The outer annular swirler includes hollow vanes with internal cavities which are in flow communication with the gas manifold, the outer swirler vanes also having a plurality of gas fuel passages therethrough in flow communication with the internal cavities to inject gas fuel into the radially-oriented air stream. An inner annular swirler is oriented axially with the mixing duct and positioned adjacent the upstream end of the mixing duct to impart swirl to an air stream entering the inner annular swirler. A holder is provided for connecting the inner and outer annular swirlers in radially spaced relation so that a passage is formed upstream of the mixing duct to direct the radially-oriented air stream swirled by the outer annular swirler into the mixing duct. The holder includes an internal cavity therein with a plurality of passages in flow communication therewith which terminate as openings along an outer radial surface of the holder. A liquid fuel manifold is positioned within the holder internal cavity and is in flow communication with a liquid fuel supply and control means. The liquid fuel manifold is also in flow communication with a fuel tube positioned in each of the holder passages to inject liquid fuel into the radially-oriented air stream directed into the mixing duct.

16 Claims, 6 Drawing Sheets

DUAL FUEL MIXER FOR GAS TURBINE COMBUSTOR

BACKGROUND OF THE INVENTION

1. Field of the Invention

The present invention relates generally to an air fuel mixer for the combustor of a gas turbine engine and, more particularly, to a dual fuel mixer for the combustor of a gas turbine engine which uniformly mixes either liquid and/or gaseous fuel with air so as to reduce NOx formed by the ignition of the fuel/air mixture.

2. Description of Related Art

Air pollution concerns worldwide have led to stricter emissions standards requiring significant reductions in gas turbine pollutant emissions, especially for industrial and power generation applications. Nitrogen Oxides (NOx), which are a precursor to atmospheric pollution, are generally formed in the high temperature regions of the gas turbine combustor by direct oxidation of atmospheric nitrogen with oxygen. Reductions in gas turbine emissions of NOx have been obtained by the reduction of flame temperatures in the combustor, such as through the injection of high purity water or steam in the combustor. Additionally, exhaust gas emissions have been reduced through measures such as selective catalytic reduction. While both the wet techniques (water/steam injection) and selective catalytic reduction have proven themselves in the field, both of these techniques require extensive use of ancillary equipment. Obviously, this drives the cost of energy production higher. Other techniques for the reduction of gas turbine emissions include "rich burnt quick quench, lean burn" and "lean premix" combustion, where the fuel is burned at a lower temperature.

In a typical aero-derivative industrial gas turbine engine, fuel is burned in an annular combustor. The fuel is metered and injected into the combustor by means of multiple nozzles along with combustion air having a designated amount of swirl. Until recently, no particular care has been exercised in the prior art in the design of the nozzle or the dome end of the combustor to mix the fuel and air uniformly to reduce the flame temperatures. Accordingly, non-uniformity of the air/fuel mixture causes the flame to be locally hotter, leading to significantly enhanced production of NOx.

In the typical aircraft gas turbine engine, flame stability and engine operability dominate combustor design requirements. This has in general resulted in combustor designs with the combustion at the dome end of the combustor proceeding at the highest possible temperatures at stoichiometric conditions. This, in turn, leads to large quantities of NOx being formed in such gas turbine combustors since it has been of secondary importance.

While premixing ducts in the prior art have been utilized in lean burning designs, they have been found to be unsatisfactory due to flashback and auto-ignition considerations for modern gas turbine applications. Flashback involves the flame of the combustor being drawn back into the mixing section, which is most often caused by a backflow from the combustor due to compressor instability and transient flows. Auto-ignition of the fuel/air mixture can occur within the premixing duct if the velocity of the air flow is not fast enough, i.e., where there is a local region of high residence time. Flashback and auto-ignition have become serious considerations in the design of mixers for aero-derivative engines due to increased pressure ratios and operating temperatures. Since one desired application of the present invention is for the LM6000 gas turbine engine, which is the aero-derivative of General Electric's CF6-80C2 engine, these considerations are of primary significance.

U.S. Pat. No. 5,251,447 to Joshi et al., which is owned by the assignee of the present invention, describes an air fuel mixer in which gaseous fuel is injected into the mixing duct thereof by means of passages in the vanes of an outer swirler. This concept was also utilized in U.S. Pat. No. 5,351,477 to Joshi et al, which is also owned by the assignee of the present invention, along with a separate manifold and passage through a hub between the outer and inner swirlers to provide dual fuel (gaseous and/or liquid) capability to the air fuel mixer. It has further been disclosed in three related applications, each entitled "Dual Fuel Mixer For Gas Turbine Combustor" and having Ser. Nos. 08/581,813, 08/581,817, and 08/581,818, that liquid fuel alternatively may be provided radially to the mixing duct via certain passage configurations in a centerbody of the air fuel mixer. In each of the dual fuel mixer designs, however, the liquid fuel has been injected into the mixing duct either parallel to the swirled air stream entering the mixing duct or at an angle thereto. It has been found in some instances that the larger drops of liquid fuel are not being mixed as well as desired.

Accordingly, it would be desirable for an air fuel mixer to be developed for the combustor of a gas turbine engine which has the capability of mixing gaseous and/or liquid fuel therein which provides greater mixing of the liquid fuel injected therein.

SUMMARY OF THE INVENTION

In accordance with one aspect of the present invention, an apparatus for premixing fuel and air prior to combustion in a gas turbine engine is disclosed as including a linear mixing duct having an upstream end, a downstream end, and a centerline axis therethrough, where the mixing duct has a circular cross-section defined by a wall. A gas fuel manifold is positioned adjacent the upstream end of the mixing duct and is in flow communication with a gas fuel supply and control means. An outer annular swirler is oriented radially to the mixing duct and positioned adjacent the upstream end of the mixing duct to impart swirl to an air stream entering the outer annular swirler. The outer annular swirler includes hollow vanes with internal cavities which are in flow communication with the gas manifold, the outer swirler vanes also having a plurality of gas fuel passages therethrough in flow communication with the internal cavities to inject gas fuel into the radially-oriented air stream. An inner annular swirler is oriented axially with the mixing duct and positioned adjacent the upstream end of the mixing duct to impart swirl to an air stream entering the inner annular swirler. A holder is provided for connecting the inner and outer annular swirlers in radially spaced relation so that a passage is formed upstream of the mixing duct to direct the radially-oriented air stream swirled by the outer annular swirler into the mixing duct. The holder includes an internal cavity therein with a plurality of passages in flow communication therewith which terminate as openings along an outer radial surface of the holder. A liquid fuel manifold is positioned within the holder internal cavity and is in flow communication with a liquid fuel supply and control means. The liquid fuel manifold is also in flow communication with a fuel tube positioned in each of the holder passages to inject liquid fuel into the radially-oriented air stream directed into the mixing duct. High pressure air from a compressor is injected into the mixing duct through the inner and outer swirlers to form an intense shear region so that gas fuel injected into the mixing duct from the outer swirler vane passages and/or liquid fuel injected into the mixing duct from the fuel tubes are uniformly mixed therein, whereby minimal formation of pollutants is produced when the fuel/air mixture is exhausted out the downstream end of the mixing duct into the combustor and ignited.

BRIEF DESCRIPTION OF THE DRAWING

While the specification concludes with claims particularly pointing out and distinctly claiming the present invention, it is believed the same will be better understood from the following description taken in conjunction with the accompanying drawing in which:

DETAILED DESCRIPTION OF THE INVENTION

Figure 1:
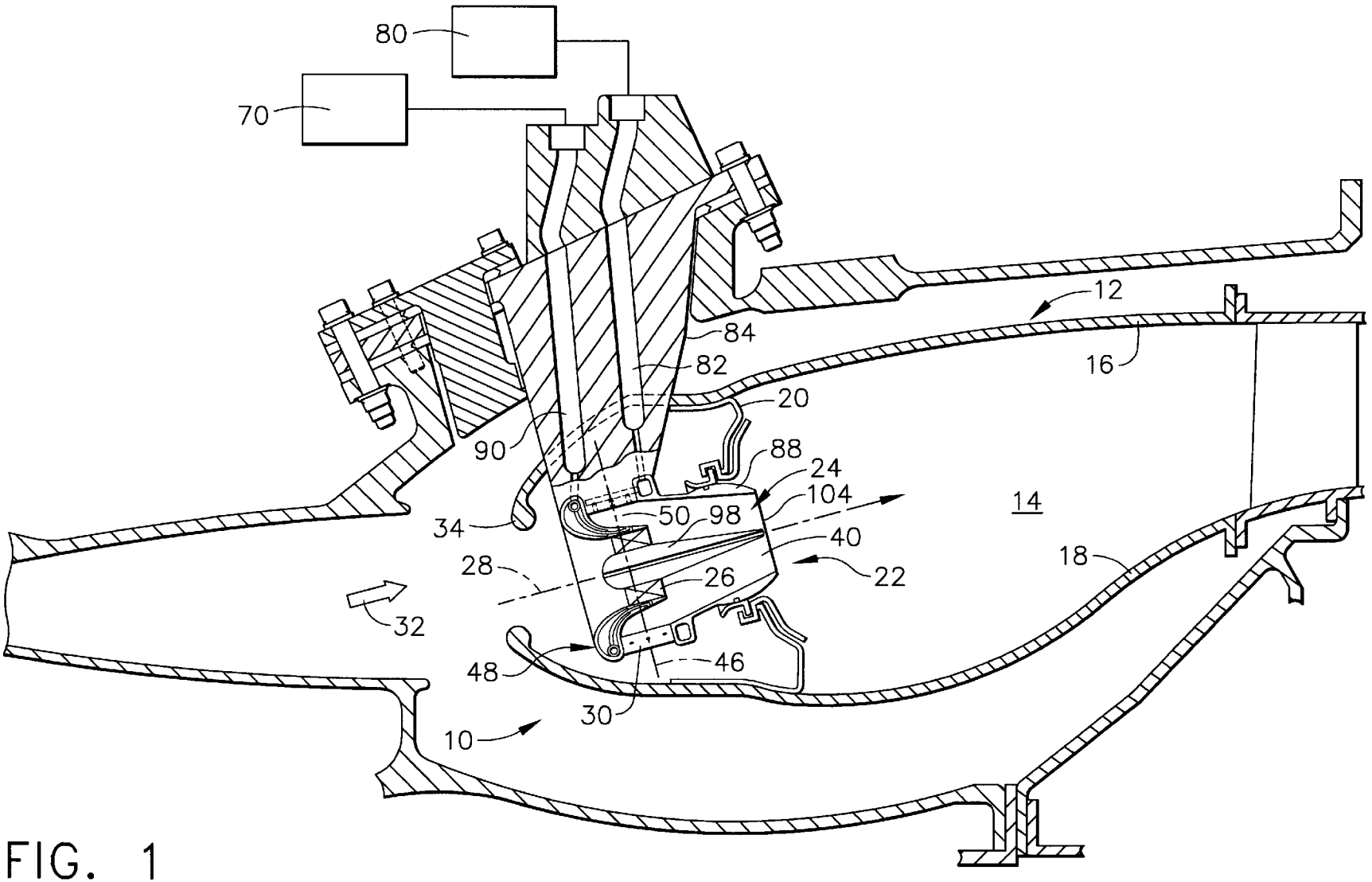
FIG. 1 is a longitudinal cross-sectional view through a single annular combustor structure including the air fuel mixer of the present invention.

Referring now to the drawing in detail, wherein identical numerals indicate the same elements throughout the figures, FIG. 1 depicts a continuous burning combustion apparatus 10 of the type suitable for use in a gas turbine engine and comprising a hollow body 12 defining a combustion chamber 14 therein. Hollow body 12 is generally annular in form and is comprised of an outer liner 16, an inner liner 18, and a domed end or dome 20. It should be understood, however, that this invention is not limited to such an annular configuration and may well be employed with equal effectiveness in combustion apparatus of the well-known cylindrical can or cannular type, as well as combustors having a plurality of annuli. In the present annular configuration, the domed end 20 of hollow body 12 includes a swirl cup 22, having disposed therein a dual fuel mixer 24 of the present invention to allow the uniform mixing of gas and/or liquid fuel and air therein. Accordingly, the subsequent introduction and ignition of the fuel/air mixture in combustion chamber 14 causes a minimal formation of pollutants. Swirl cup 22, which is shown generally in FIG. 1, is made up of mixer 24 and the swirling means described below.

As seen in FIGS. 1–3, 5, and 6, mixer 24 includes an inner annular swirler 26 oriented axially with a centerline axis 28 through mixer 24 and an outer annular swirler 30 oriented substantially radially (i.e., perpendicular) to axis 28. Inner swirler 26 will be positioned to extend axially so that its downstream end will preferably lie substantially in the same plane as the downstream end of outer swirler 30. It will be understood that inner and outer swirlers 26 and 30 are brazed or otherwise set in swirl cup 22. A pressurized flow of air 32 from a compressor upstream of combustor 10 is preferably directed into inner and outer annular swirlers 26 and 30 by a cowl 34 so that a swirled axial airstream 36 and a swirled radial air stream 38, respectively, are produced. It is of no significance which direction inner swirler 26 and outer swirler 30 causes air to rotate so long as they do so in opposite directions when air streams 36 and 38 enter a mixing duct 40 downstream thereof (i.e., if outer swirler 30 is rotated approximately 90° into parallel alignment with inner swirler 26). It will be understood that inner swirler 26 has vanes 42 preferably at an angle in the 40°–60° range with centerline axis 28 while outer swirler 30 also has vanes 44 at an angle in the 40°–60° range with respect to an axis 46 through each outer swirler vane 44 which is substantially perpendicular to centerline axis 28 (see FIGS. 3 and 4). Also, the air mass ratio between inner swirler 26 and outer swirler 30 is preferably approximately 1:3.

A holder 48 is provided for connecting inner and outer swirlers 26 and 30 in radially spaced relation so that a passage 50 is formed therebetween. It will be seen best from FIGS. 2 and 3 that holder 48 is preferably flared radially inward from an upstream end 52 connected to an upstream side 54 of outer swirler 30 to a downstream end 56 connected to an outer radial surface 58 of inner swirler 26. Holder 48 will preferably be thicker at upstream end 52 than downstream end 56. It will further be noted that an outer radial surface 60 of holder 48 used to form passage 50 preferably is curved to turn radial air stream 38 so that it is directed substantially axially into mixing duct 40 immediately downstream of inner and outer swirlers 26 and 30 and interacts with swirler axial air stream 36 to form intense shear layers 94 in mixing duct 40 (see lower half of FIGS. 2 and 3).

Figure 2:
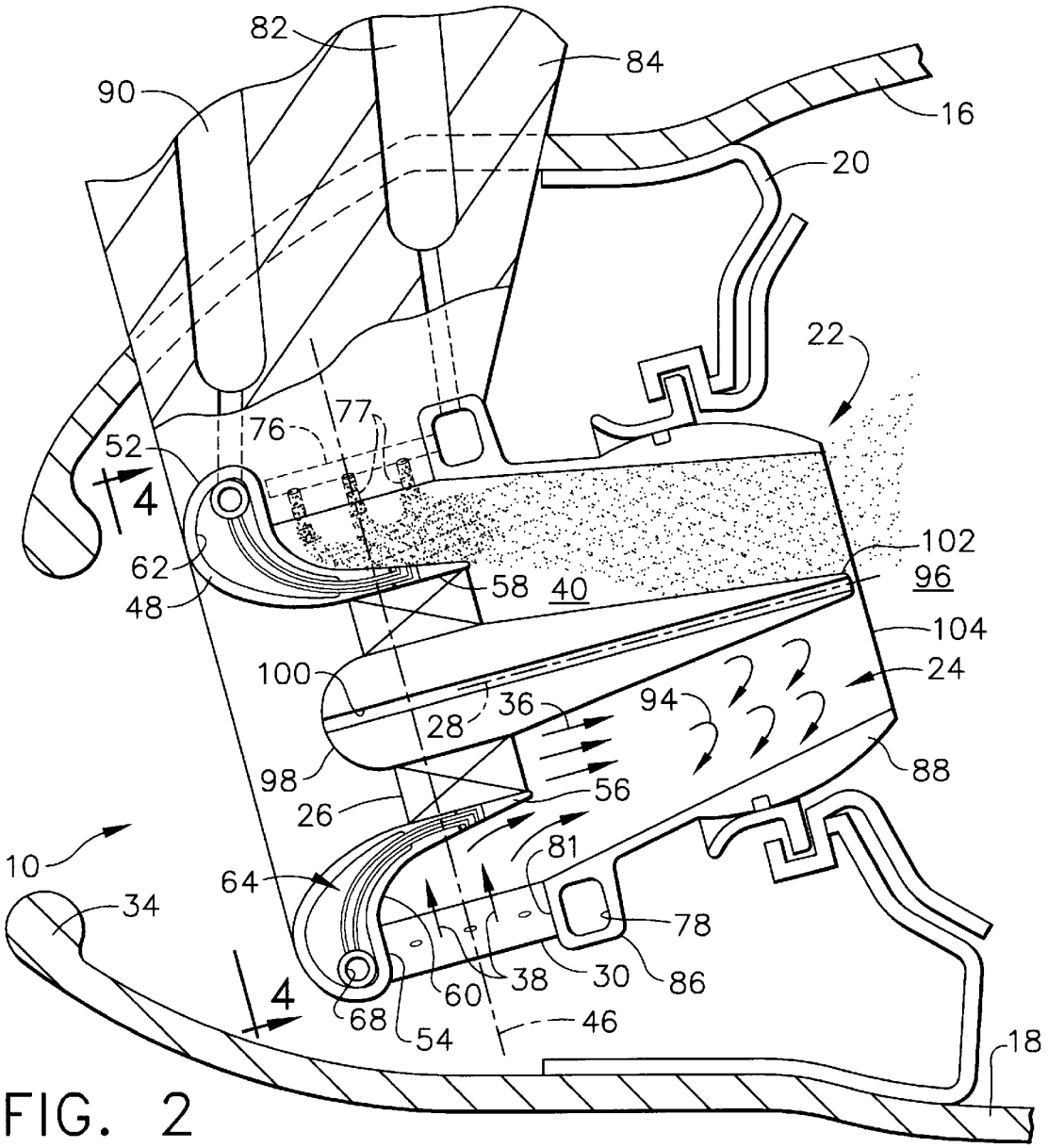
FIG. 2 is an enlarged cross-sectional view of the air fuel mixer of the present invention and combustor dome portion of FIG. 1 which depicts gaseous fuel being injected in the upper half thereof and the swirled air streams from the outer and inner swirlers entering the mixing duct in the lower half thereof to provide intense shear layers therein.
Figure 2A:
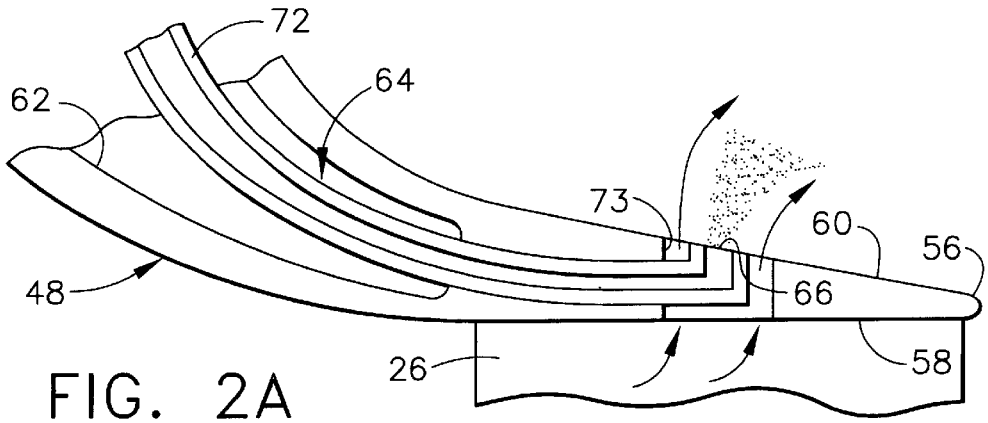
FIG. 2A is an enlarged partial cross-sectional view of the holder depicted in FIGS. 1 and 2.
Figure 2B:
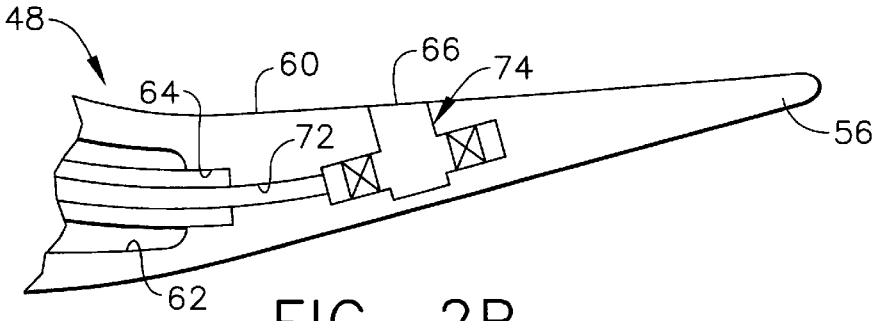
FIG. 2B is an enlarged partial cross-sectional view of the holder depicted in FIGS. 1 and 2, where an atomizer is provided at the downstream end of each liquid fuel injection tube.
Figure 3:
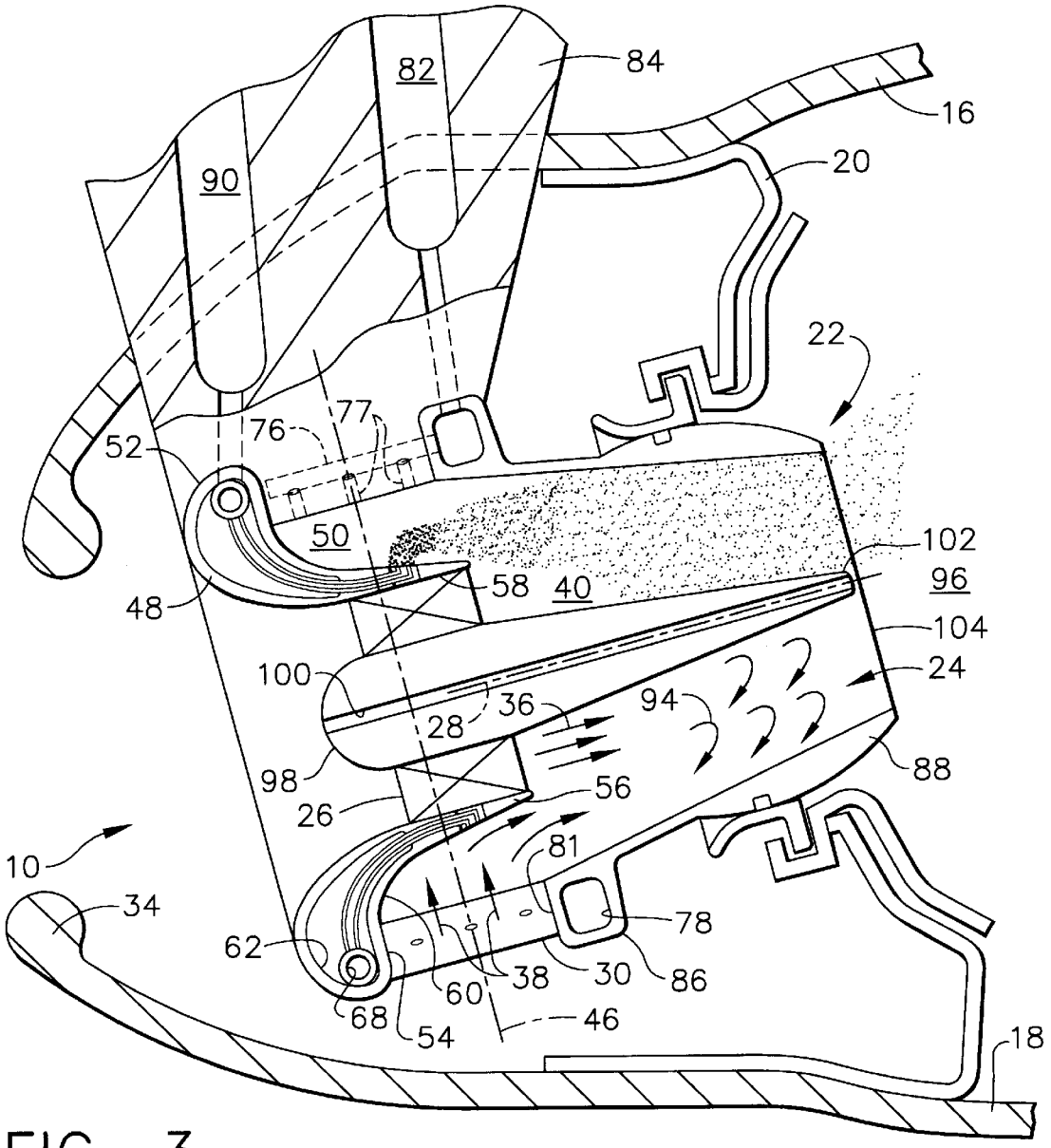
FIG. 3 is an enlarged cross-sectional view of the air fuel mixer of the present invention and combustor dome portion of FIG. 1 which depicts liquid fuel being injected in the upper half thereof and the swirled air streams from the outer and inner swirlers entering the mixing duct in the lower half thereof to provide intense shear layers therein.
Figure 4:
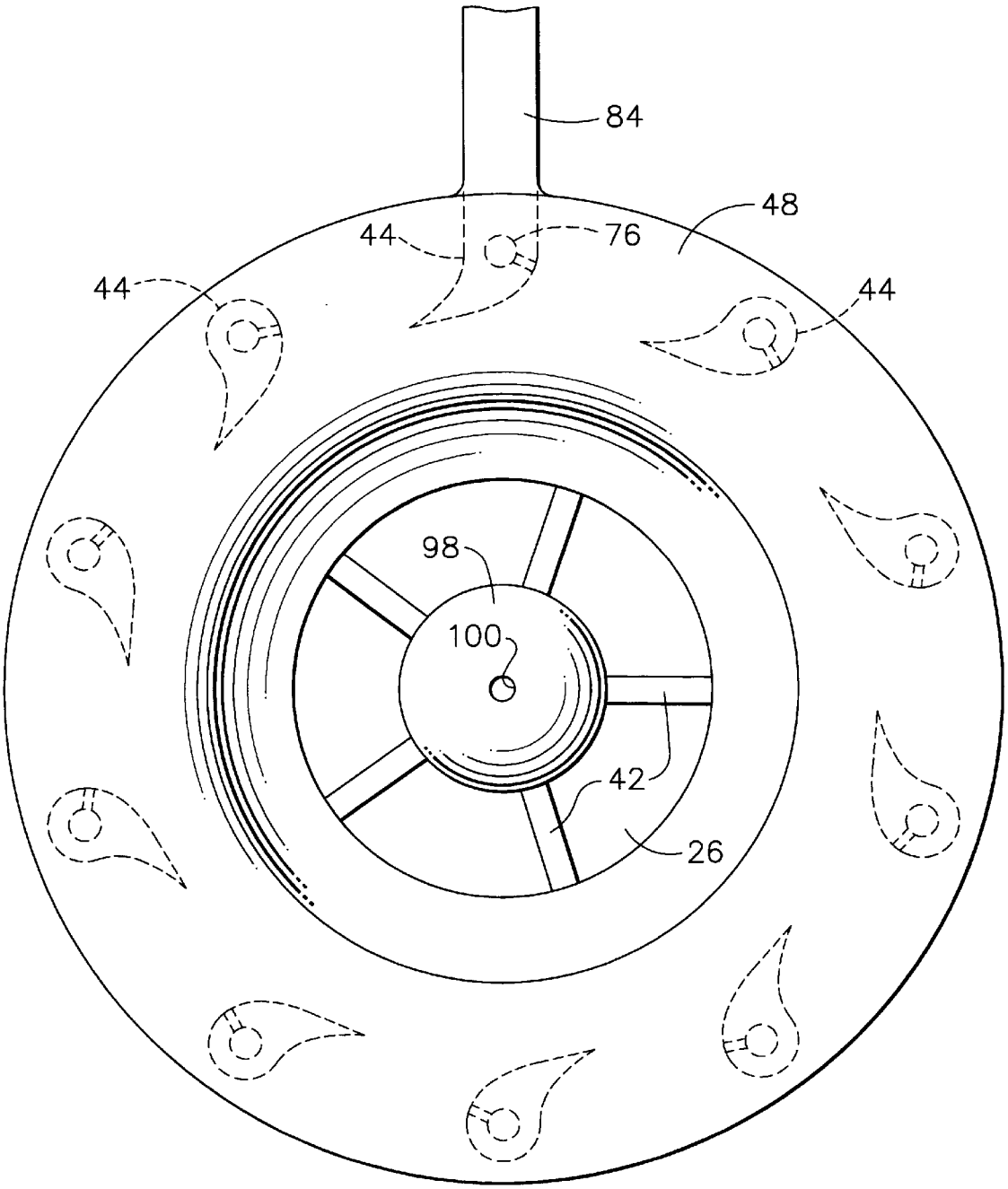
FIG. 4 is a front view of the air fuel mixer taken along line 4—4 of FIG. 2.
Figure 5:
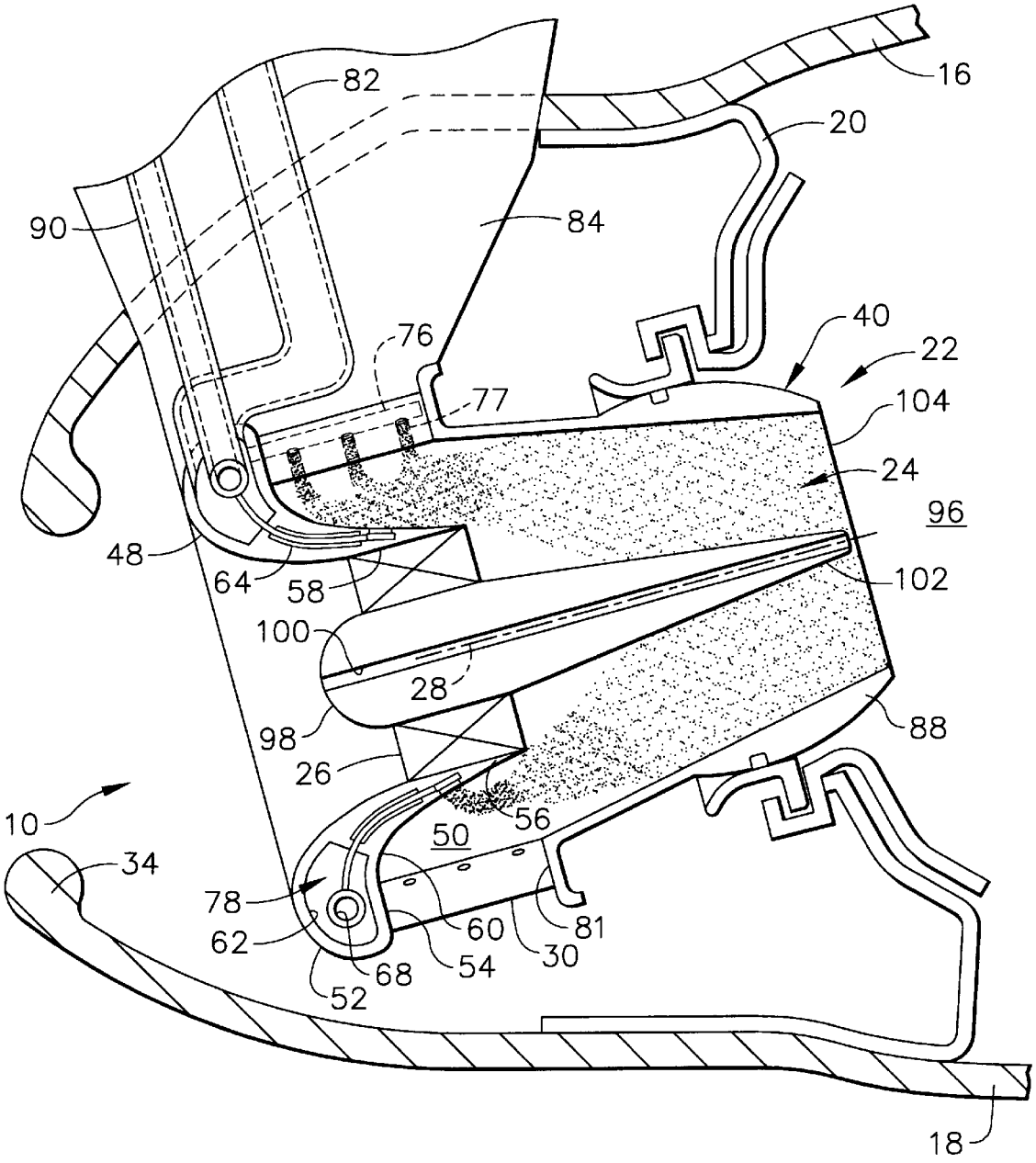
FIG. 5 is an enlarged cross-sectional view of the air fuel mixer of the present invention and combustor dome portion of FIG. 1 which depicts an alternative location for the gas fuel manifold.

As seen in FIGS. 2, 3, and 5, holder 48 preferably is hollow and includes an internal cavity 62 in upstream end 52 thereof with a plurality of passages 64 extending from holder 48 in a configuration so that they terminate with individual openings 66 on outer radial surface 60, where openings 66 are preferably oriented toward the trailing edge of outer swirler vanes 44 (see FIG. 2A). It will be noted that a liquid fuel manifold 68 preferably is located within internal cavity 62 of holder 48 which is in flow communication with a fuel supply and control means 70. Fuel tubes 72 are positioned within each holder passage 64 so as to be in flow communication with liquid fuel manifold 68. In this way, liquid fuel is injected through openings 66 directly into and against radial air stream 38. This permits larger drops of the liquid fuel to better interact with such air stream instead of being injected at an angle thereto. In order to minimize the size of liquid fuel drops injected in to passage 50, a bleed passage 73 is provided in holder 48 which is in flow communication with inner swirler 26 (see FIG. 2A) or atomizers 74 are provided adjacent openings 66 in holder outer radial 60 (see FIG. 2B).

Figure 6:
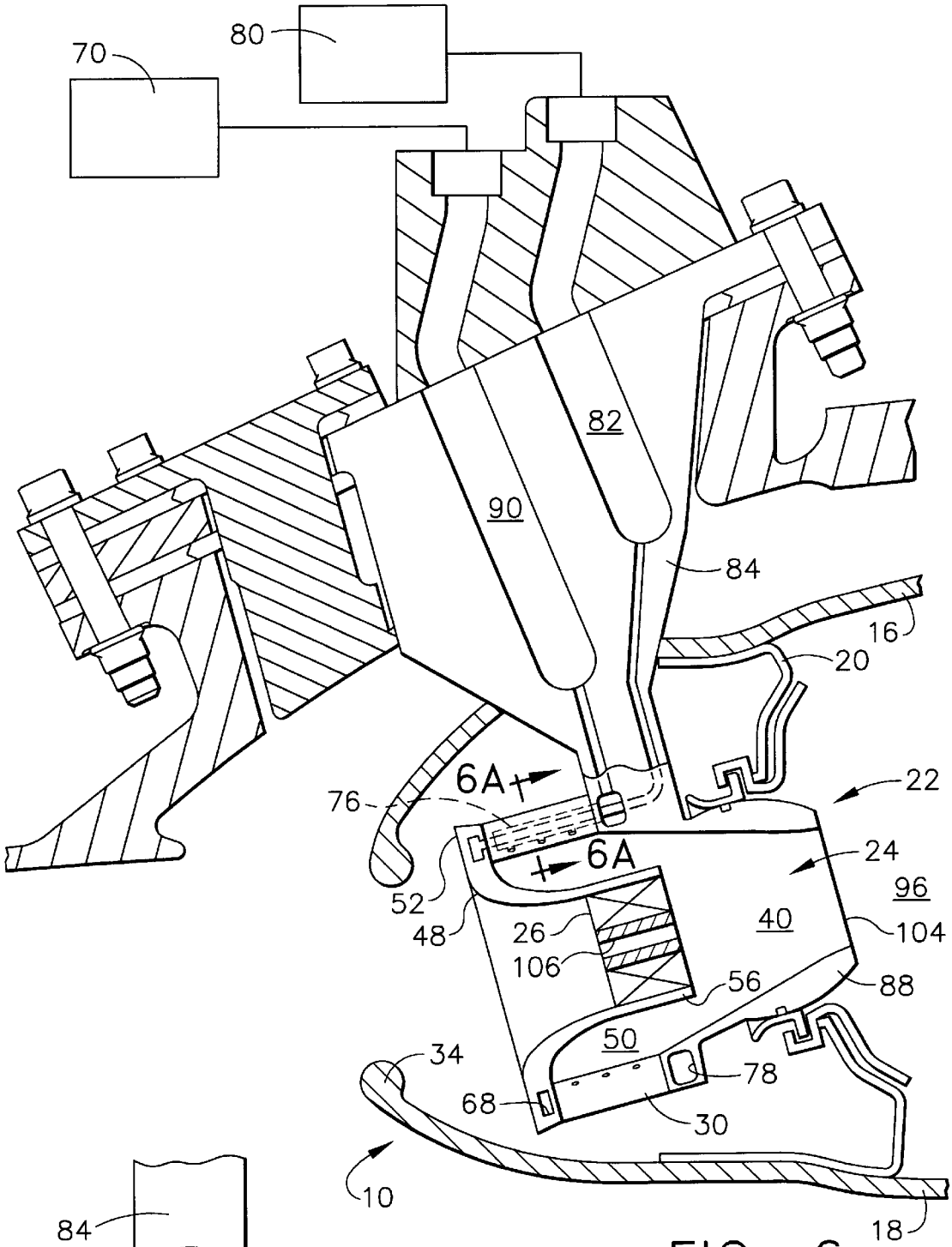
FIG. 6 is an enlarged cross-sectional view of the air fuel mixer of the present invention and combustor dome portion of FIG. 1 which depicts an alternative mixer stem configuration located downstream of the outer swirler, as well as the elimination of the centerbody.
Figure 6A:
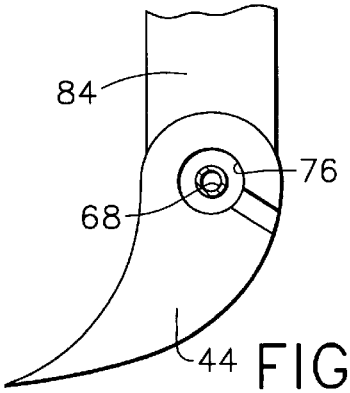
FIG. 6A is a sectional view taken along line 6A—6A in FIG. 6.

As with the previous patents discussed previously herein, outer swirler vanes 44 preferably are hollow and include an internal cavity 76 therein which is in flow communication with a gas fuel manifold 78 located adjacent an upstream end of mixing duct 40. Internal cavity 76 of outer swirler vanes 44 has a plurality of passages 77 in flow communication therewith to inject gas fuel into radial air stream 38. Gas fuel manifold 78 is likewise in flow communication with a gas fuel supply and control means 80 via a fuel line 82 through a mixer stem 84. As seen in FIGS. 1–3 and 5, mixer stem 84 is positioned radially outside and in axial alignment with mixer 24 so that gas fuel manifold 78 is contained within an enlarged upstream end portion 86 of a wall 88 defining mixing duct 40 (to which outer swirler is connected at a downstream side 81). Mixer stem 84 may alternatively be configured and/or positioned axially downstream of outer swirler 30 (as shown in FIG. 6) to better allow air flow 32 to enter outer swirler 30. In either mixer stem design, liquid fuel is supplied to liquid fuel manifold 68 in holder upstream end 52 via a fuel line 90 in mixer stem 84 which is routed through an outer swirler vane 44 or around outer swirler 30. Gas fuel may also be injected directly into mixing duct 40 via one or more passages in mixing duct wall 88 which are in flow communication with gas fuel manifold 78 (not shown). Alternatively, gas fuel manifold 78 may be positioned within internal cavity 62 of holder 48 (see FIG. 5). In this design, liquid fuel manifold 68 preferably is positioned within gas fuel manifold 78 to provide insulation and thereby reduce the likelihood of the liquid fuel coking.

As shown in the lower half of mixer 24 in FIGS. 2 and 3, air stream 36 exiting inner swirler 26 and air stream 38 exiting outer swirler 30 sets up an intense shear layer 94 in mixing duct 40. Shear layer 94 is tailored to enhance the mixing process, whereby fuel flowing through outer swirler vanes 44 and fuel tubes 72 in holder passages 64 are uniformly mixed with intense shear layer 94 from swirlers 26 and 30, as well as prevent backflow along the inner surface of mixing duct 40. Mixing duct 40 may be a straight cylindrical section, but preferably should be frusto-conical in shape where the diameter at its upstream end is greater than the diameter at its downstream end so as to increase fuel-air mixture velocities and prevent backflow from primary combustion region 96.

As seen in FIGS. 1–3 and 5, a centerbody 98 is provided in mixer 24 which may be a straight cylindrical section or preferably one which converges substantially uniformly from its upstream end to its downstream end. Centerbody 98 is preferably cast within mixer 24 and is sized so as to terminate immediately prior to the downstream end of mixing duct 40. Centerbody 98 includes a passage 100 therethrough in order to admit air of a relatively high axial velocity into combustion chamber 14 adjacent a centerbody tip 102, whereby the local fuel/air ratio is decreased to help push the flame downstream of centerbody tip 102. Alternatively, centerbody 98 may be shortened so as not to extend adjacent the downstream end of mixing duct 40 or even eliminated (see FIG. 6) with a passage 106 provided along centerline axis 28 in inner swirler 26. Of course, it will be appreciated that any passage through a shortened centerbody or inner swirler 26 will preferably be larger in diameter than passage 100 of centerbody 98 since the diameter of mixing duct 40 is greater at such upstream locations.

It will be understood that mixer 24 of combustor 10 may change from operation by gas fuel to one of liquid fuel (and vice versa). During such transition periods, the gas fuel flow rate is decreased (or increased) gradually and the liquid fuel flow rate is increased (or decreased) gradually. Since normal fuel flow rates are in the range of 1000–20,000 pounds per hour, the approximate time period for fuel transition is 0.5–5 minutes. Of course, gas fuel supply and control mechanism 80 and liquid fuel supply and control mechanism 70 monitor such flow rates to ensure the proper transition criteria are followed. In this regard, it will be understood that mixer 24 is configured so that purge air may be supplied to liquid fuel manifold 68 and fuel tubes 72 when gas fuel is being supplied to mixing duct 40. Likewise, purge air may also be supplied to gas fuel manifold 78 when liquid fuel is being supplied to mixing duct 40.

Inner and outer swirlers 26 and 30 are designed to pass a specified amount of air flow, and gas fuel manifold 78 and liquid fuel manifold 68 are sized to permit a specified amount of fuel flow so as to result in a lean premixture at an exit plane 104 located at the downstream end of mixing duct 40. By "lean" it is meant that the fuel/air mixture contains more air than is required to fully combust the fuel, or an equivalence ratio of less than one. It has been found that an equivalence ratio in the range of 0.4 to 0.7 is preferred.

In operation, compressed air 32 from a compressor (not shown) is injected into the upstream end of mixer 24 where it passes between cowl 34 through inner and outer swirlers 26 and 30 and enters mixing duct 40. Gas fuel is injected into air stream 38 from passages 77 in outer swirler vanes 44 in flow communication with gas fuel manifold 78 and is mixed as shown in FIG. 2. Alternatively, liquid fuel is injected into air stream 38 from fuel tubes 72 and mixed as shown in FIG. 3. At the downstream end of mixing duct 40, the fuel/air mixture is exhausted into primary combustion region 96 of combustion chamber 14 which is bounded by inner and outer liners 18 and 16.

The fuel/air mixture then burns in combustion chamber 14, where a flame recirculation zone is set up with help from the swirling flow exiting mixing duct 40. In particular, it should be emphasized that air streams 36 and 38 emanating from swirlers 26 and 30, respectively, form very energetic shear layers 94 where intense mixing of fuel and air is achieved by intense dissipation of turbulent energy of the two co-flowing air streams. The fuel is injected into passage 50 between inner and outer swirlers 26 and 30 upstream of mixing duct 40 to permit greater dissipation of liquid fuel drops prior to entering energetic shear layers 94 so that macro and micro mixing takes place in a very short region or distance. In this way, the maximum amount of mixing between the fuel and air supplied to mixing duct 40 takes place in the limited amount of space available in an aero-derivative engine.

Having shown and described the preferred embodiment of the present invention, further adaptations of the dual fuel mixer for providing uniform mixing of fuel and air can be accomplished by appropriate modifications by one of ordinary skill in the art without departing from the scope of the invention.

What is claimed is:

1. An apparatus for premixing fuel and air prior to combustion in a gas turbine engine, comprising:

(a) a linear mixing duct having an upstream end, a downstream end, and a centerline axis therethrough, said mixing duct having a circular cross-section defined by a wall;

(b) a gas fuel manifold positioned adjacent the upstream end of said mixing duct, said gas fuel manifold being in flow communication with a gas fuel supply and control means;

(c) an outer annular swirler oriented radially to said mixing duct and positioned adjacent the upstream end of said mixing duct for imparting swirl to an air stream entering said outer annular swirler, said outer annular swirler including hollow vanes with internal cavities, wherein the internal cavities of said outer swirler vanes are in flow communication with said gas manifold, and said outer swirler vanes have a plurality of gas fuel passages therethrough in flow communication with said internal cavities to inject gas fuel into a radially-oriented air stream;

(d) an inner annular swirler oriented axially with said mixing duct and positioned adjacent the upstream end thereof to impart swirl to an air stream entering said inner annular swirler;

(e) a holder for connecting said inner and outer annular swirlers in radially spaced relation so that a passage is formed upstream of said mixing duct to direct the radially-oriented air stream swirled by said outer annular swirler into said mixing duct, said holder including an internal cavity therein with a plurality of passages extending from within said holder internal cavity which terminate as openings along an outer radial surface of said holder;

(f) a liquid fuel manifold positioned within said holder internal cavity, said liquid fuel manifold being in flow communication with a liquid fuel supply and control means, wherein said liquid fuel manifold is also in flow communication with a fuel tube positioned in each of said holder passages to inject liquid fuel into the radially-oriented air stream directed into said mixing duct;

wherein high pressure air from a compressor is injected into said mixing duct through said inner and outer swirlers to form an intense shear region, and gas fuel is injected into said mixing duct from said outer swirler vane passages and/or liquid fuel is injected into said mixing duct from said fuel tubes so that the high pressure air and the fuel is uniformly mixed therein, whereby minimal formation of pollutants is produced when the fuel/air mixture is exhausted out the downstream end of said mixing duct into the combustor and ignited.

2. The apparatus of claim 1, said gas fuel manifold being located within an upstream end of said mixing duct wall.

3. The apparatus of claim 1, said gas fuel manifold being located within said internal cavity of said holder.

4. The apparatus of claim 3, said liquid fuel manifold being located within said gas fuel manifold.

5. The apparatus of claim 1, further comprising a centerbody located axially along said mixing duct and radially inward of said inner annular swirler.

6. The apparatus of claim 5, said centerbody including an air passage therethrough.

7. The apparatus of claim 1, said inner and outer annular swirlers including vanes which are oriented so that the respective swirled air streams therefrom entering said mixing duct are rotated in opposite directions.

8. The apparatus of claim 1, further comprising an atomizer located adjacent the opening of each holder passage.

9. The apparatus of claim 8, said atomizers being oriented radially outward toward said outer swirler vanes.

10. The apparatus of claim 1, wherein said outer annular swirler is connected to said holder at an upstream side and to said mixing duct wall at a downstream side.

11. The apparatus of claim 10, wherein said inner annular swirler extends axially to approximately said downstream side of said outer annular swirler.

12. The apparatus of claim 10, wherein said holder is flared radially inward from an upstream end connected to said outer annular swirler upstream side to a downstream end connected to said inner annular swirler.

13. The apparatus of claim 1, said mixer stem further comprising:

(a) a first passage in flow communication with said gas fuel supply and control means at a first end and with said gas fuel manifold at a second end; and (b) a second passage in flow communication with said liquid fuel supply and control means at a first end and with said liquid fuel manifold at a second end.

14. The apparatus of claim 13, wherein said mixer stem is located axially downstream of said outer swirler.

15. The apparatus of claim 13, said second passage of said mixer stem and said liquid fuel manifold being in flow communication via said internal cavity of at least one of said outer swirler vanes.

16. The apparatus of claim 1, further comprising a passage through said inner swirler along said centerline axis.

* * * * *